US007377890B2

(12) United States Patent
Liu

(10) Patent No.: US 7,377,890 B2
(45) Date of Patent: May 27, 2008

(54) APPARATUS FOR EXERCISING A HYPOGASTRIUM OF A USER

(75) Inventor: Shih-Ta Liu, Taoyuan Hsien (TW)

(73) Assignee: Biboting International Co., Ltd., Taoyuan Hsien (TW)

( * ) Notice: Subject to any disclaimer, the term of this patent is extended or adjusted under 35 U.S.C. 154(b) by 376 days.

(21) Appl. No.: 10/877,308

(22) Filed: Jun. 25, 2004

(65) Prior Publication Data

US 2004/0267172 A1 Dec. 30, 2004

(30) Foreign Application Priority Data

Jun. 26, 2003 (TW) ..... 92211685 U

(51) Int. Cl.
*A63B 71/00* (2006.01)

(52) U.S. Cl. ..... 482/148; 601/49

(58) Field of Classification Search ..... 482/148; 601/46

See application file for complete search history.

(56) References Cited

U.S. PATENT DOCUMENTS

| | | | | |
|---|---|---|---|---|
| 5,300,052 | A * | 4/1994 | Kubo | 604/349 |
| 5,336,158 | A * | 8/1994 | Huggins et al. | 601/14 |
| 5,733,230 | A * | 3/1998 | Sawchuck et al. | 482/111 |
| 6,099,463 | A * | 8/2000 | Hockhalter | 600/38 |
| 6,905,471 | B2 * | 6/2005 | Leivseth et al. | 600/591 |

* cited by examiner

*Primary Examiner*—Lori Amerson
(74) *Attorney, Agent, or Firm*—Volpe and Koenig, P.C.

(57) ABSTRACT

An exercising apparatus is provided. The apparatus includes a cup having a lateral side for being adhered to a join section between a leg and a body of the user, an upper side for being adhered to an abdomen of the user, a lower side for being adhered to an anal area of the user, a tube connected to the cup and an air pump for sucking an air inside the cup out through the tube. When the air is exhausted out from the cup, the hypogastrium is bulged, and then when the air gets into the cup, the hypogastrium is restored, such that, the hypogastrium is exercised by being released and contracted.

19 Claims, 14 Drawing Sheets

APPARATUS FOR EXERCISING A HYPOGASTRIUM OF A USER

FIELD OF THE INVENTION

The present invention is related to an apparatus for exercising an area of a user's body. More particularly, the present invention is directed to an apparatus for exercising a hypogastrium of a user, to reform and activate thereof.

BACKGROUND OF THE INVENTION

As known, the vaginal fascia is loosen after delivery and/or being pregnant and it might result in incontinence of urine and uterine prolapse. In all therapies for curing those problems, an exercise is the non-invasive therapy. The most popular exercise is the Kegel exercise for reinforcing the muscle of the pelvic. To cure the incontinence of urine by training the pubococcygeus muscles to rectify the dropping of the organs in the pelvic. The organs includes uterus, urinary bladder, and rectum.

In the Kegel exercise, it is necessary to exercise levator ani. Only after correctly exercising the pubococcygeus muscles and exactly feeling the contraction of these muscles, the Kegel exercise can prove its success. Each cycle needs to contract the levator ani and maintain the contraction at least five seconds, and then releases slowly, and finally rests for five seconds. In one day, the exercise of pubococcygeus muscles must be taken for three rounds, in which each round has fifteen to twenty cycles of contraction of the levator ani. Furthermore, the contraction time may extend to ten seconds or more. This is the training of the endurance of the pubococcygeus muscles. On the other hands, the levator ani also can be contracted and released rapidly for training the explosive contraction of the pubococcygeus muscles. As long as the training of Kegel exercise is maintained at least six to eight weeks, the result will get much better.

Dr. Kegel trained about eight hundred patients to practice Kegel exercise and about eighty percents of patients are favorably effected by Kegel exercise. Kegel exercise is safe and can be practiced in the life time of a patient. Not only the incontinence of urine can be improved by Kegel exercise, but also the contraction of the pubococcygeus muscles can be reinforced thereby so that the fun of the copulation is increased.

Furthermore, Kegel exercise is also helpful for a male patient to improve the incontinence of urine after a surgery of prostate, such as Benign Prostatic Hypertrophy (BPH) or the prostate cancer. And by the training of the Kegel exercise including the raise and contraction of the pubococcygeus muscles, the male patient finds alleviated the symptom of the incontinence of urine. However, please refer to FIG. 1, which shows the contraction measuring equipment 10 for the vagina. The equipment 10 is dedicated for measuring the contraction of the vagina. But the equipment for Kegel exercise has not yet been be invented.

It is, therefore, an object of the present invention to provide an apparatus for exercising a hypogastrium of a user.

SUMMARY OF THE INVENTION

The present apparatus employs an air pump to provide a negative pressure inside a cup to exercise the hypogastrium of a user.

An apparatus for exercising a hypogastrium of a user, which includes a cup having a lateral side for being adhered to a join section between a leg and a body of the user, an upper side for being adhered to an abdomen of the user, and a lower side for being adhered an anal area of the user, a tube connected to the cup and an air pump for sucking an air inside the cup out through the tube, when the air is exhausted out from the cup, the hypogastrium is bulged, and then when the air gets into the cup, the hypogastrium is restored, such that, the hypogastrium is exercised by being released and contracted.

In particular, the apparatus further comprises a vibrator.

In particular, the vibrator generates a vibration on the cup by driving an eccentric device.

In particular, the vibrator generates a reciprocating motion.

In particular, the vibrator is supplied by an external electric power.

In particular, the vibrator has an electric power supplied by a battery placed therein.

In particular, the apparatus further comprises a relief valve for releasing a negative pressure in the cup for safety while the negative pressure is bigger than a preset value.

In particular, the cup further has a room for a male user.

In particular, the apparatus further comprises a soft pad adhered along the lateral side, the upper side, and the lower side.

In particular, the air pump is a manual pump.

In particular, the air pump comprises plural vacuum pumps.

In particular, the air pump further comprises a controller for presetting an exercise schedule and controlling a strength, and a pumping speed.

In particular, the exercise schedule comprises an air-exhausting scheme, an air-retrieving scheme and an vibration generated by the vibrator.

To achieve the object, the present invention further provides an apparatus for exercising a hypogastrium of a user. The apparatus comprises a cup having an opening for covering the hypogastrium of the user, a vibrator placed on the cup for vibrating therewith, and an air pump for exhausting an air inside of the cup out, and the opening is adhered to a join section of a leg and a body of the user, an abdomen of the user, and an anal of the user.

According to the present invention, the cup further has a relief valve thereon for releasing a negative pressure in the cup for safety while the negative pressure is bigger than a preset value.

According to the present invention, wherein the vibrator generates a vibration on the cup by driving an eccentric device.

According to the present invention, wherein the vibrator generates a reciprocating motion.

To achieve the object, the present invention further provides another apparatus for exercising a hypogastrium of a user. The apparatus comprises a cup having an opening for covering the hypogastrium, a vibrator placed on the cup for vibrating therewith, an air pump for exhausting an air inside of the cup out through a tube, and a controller for controlling the air pump, and thus the opening is adhered to a join section between a leg and a body of the user, an abdomen of the user, and an anal area of the user.

Preferably, the controller controls a pumping strength, a speed and a period provided by the air pump.

Preferably, the controller controls a frequency and an amplitude provided by the vibrator.

Now the foregoing and other features and advantages of the present invention will be more clearly understood through the following descriptions with reference to the accompanying drawings, in which:

DETAILED DESCRIPTION OF THE PREFERRED EMBODIMENT

Figure 1:
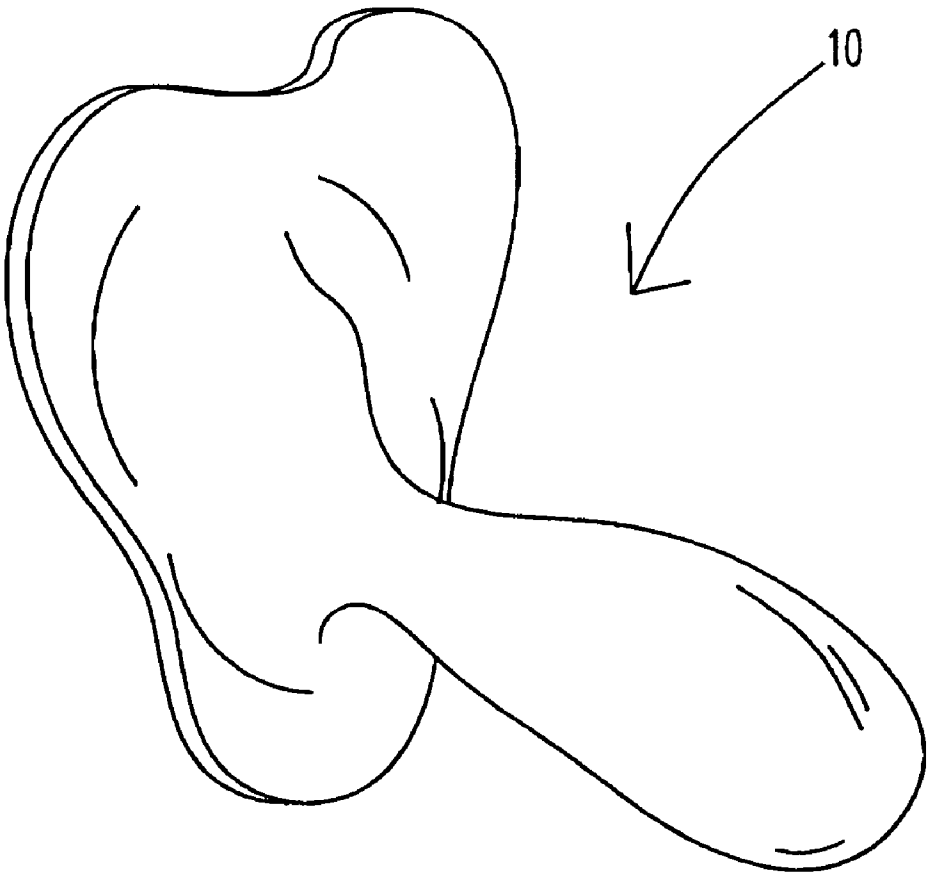
FIG. 1 is a contraction measuring equipment of a prior art.
Figure 2:
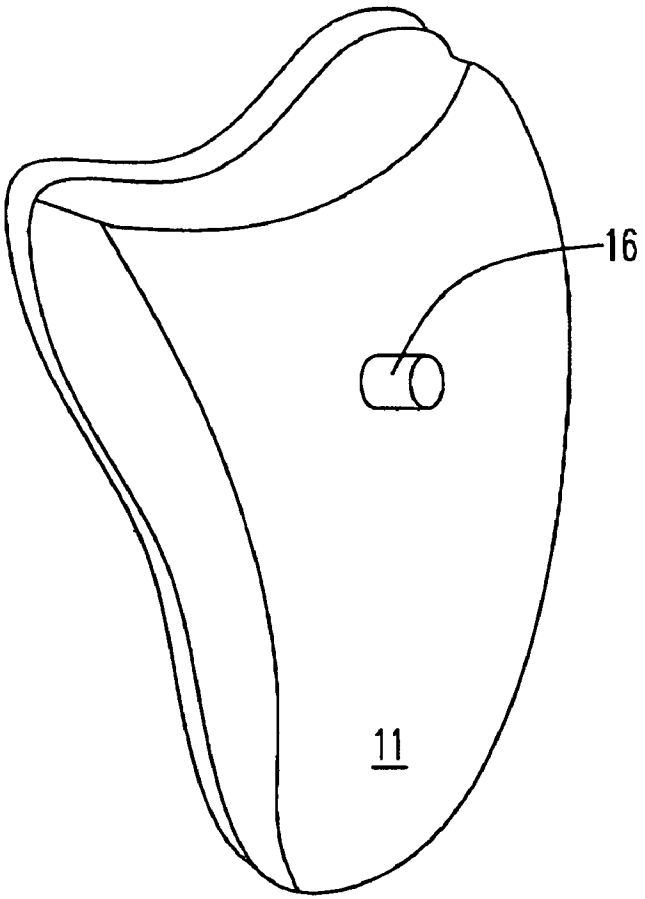
FIG. 2 is a schematic view according to a preferred embodiment of the present invention.
Figure 3:
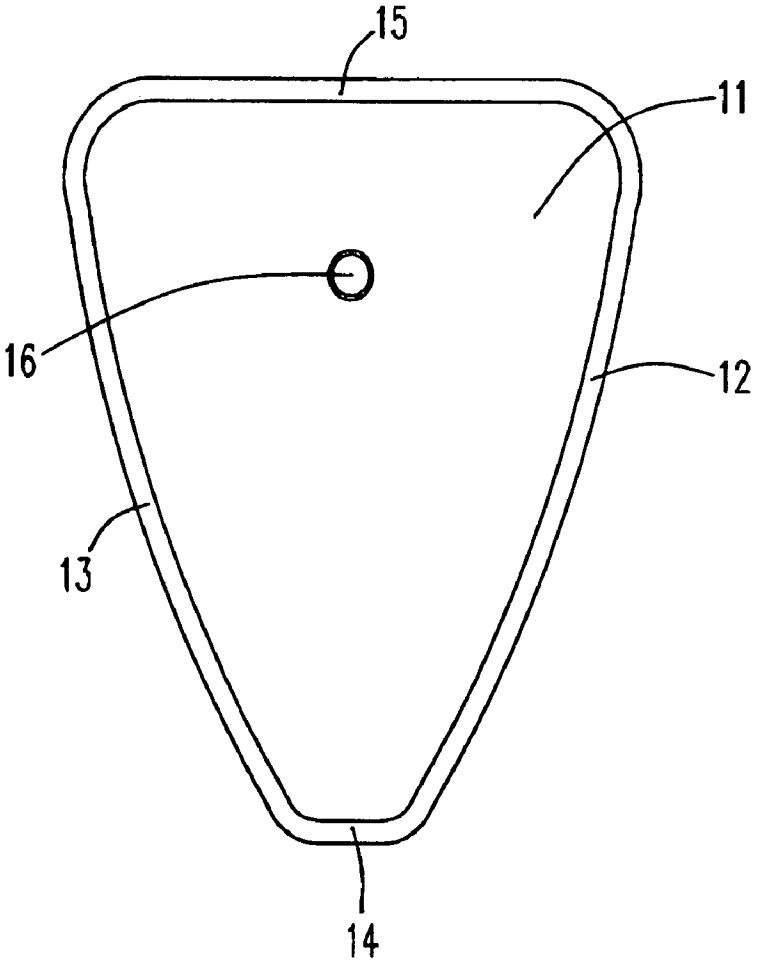
FIG. 3 is a front view according to the preferred embodiment of the present invention in FIG. 2.

Please refer to FIGS. 2 and 3, an embodiment of the present invention is illustrated. The embodiment of the present invention has a cup 11 made by solid material. The cup 11 includes an opening having two lateral sides 12, and 13 adhered to a join section of a leg and a body of a user. The opening has an upper side 15 to be adhered to an abdomen of a user and a lower side 14 to be adhered to an anal area of a user. The cup 11 further has an aperture 16 to communicate an interior of the cup 11 to an atmosphere. A check valve also can be disposed inside the aperture 16 to prevent the air from flowing back into the cup 11.

Figure 4:
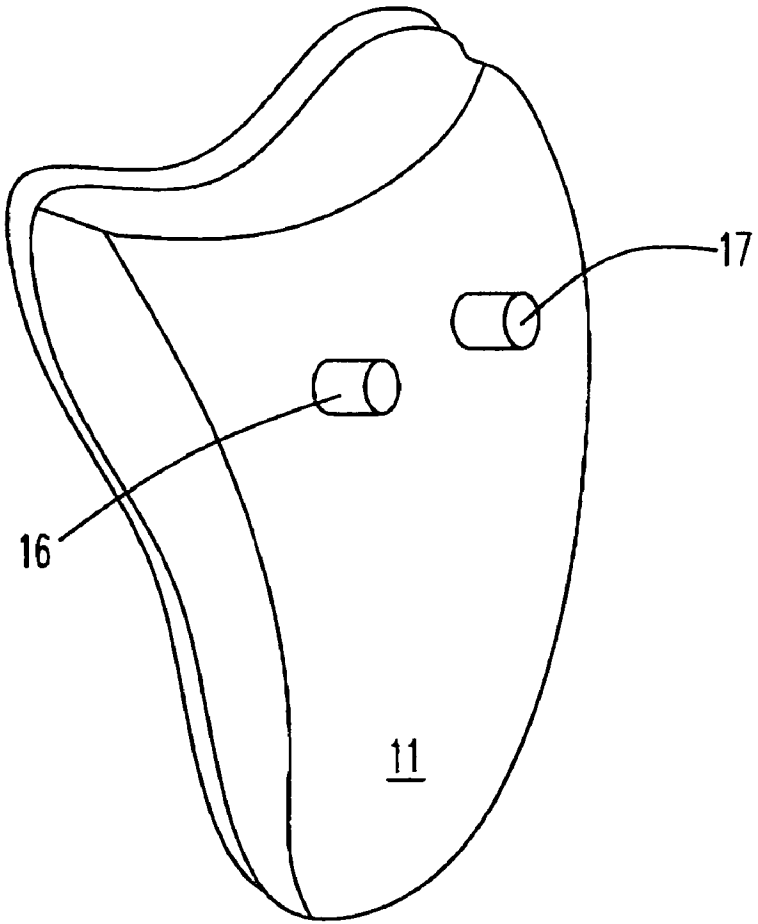
FIG. 4 is a schematic view according to a preferred embodiment having a relief valve of the present invention.
Figure 5:
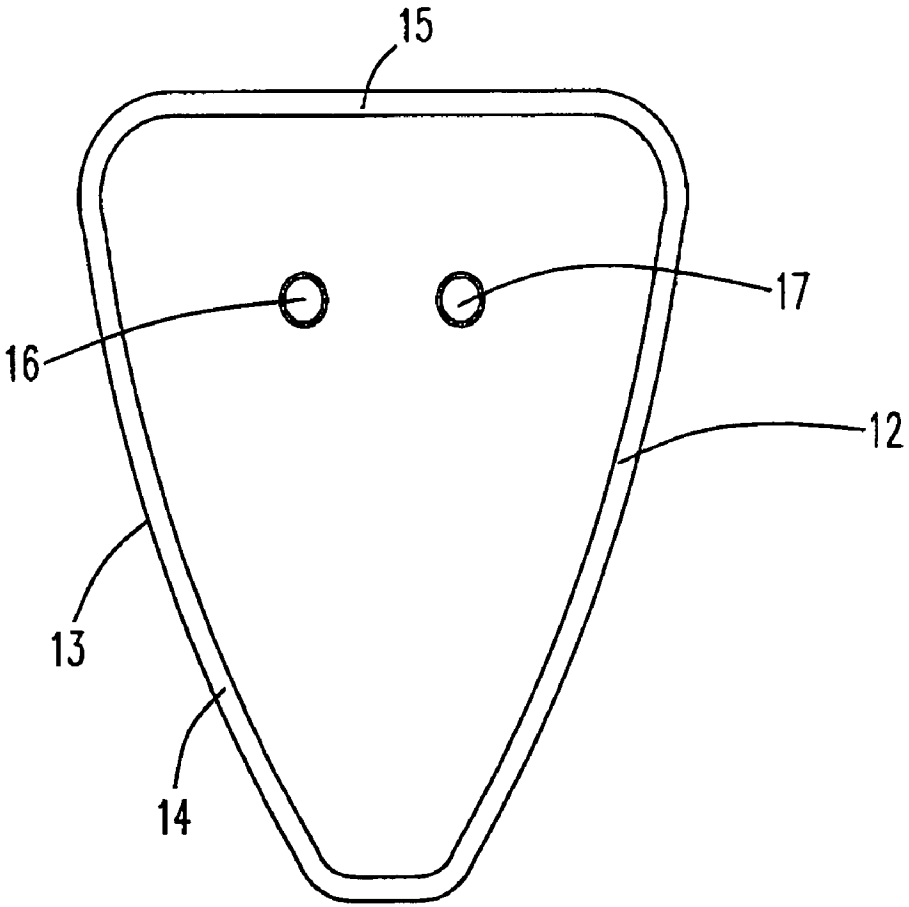
FIG. 5 is a front view according to the preferred embodiment of the present invention in FIG. 4.

Please refer to FIGS. 4 and 5, another embodiment of the present invention is illustrated. The cup 11 further has a relief valve 17 for releasing a negative pressure in the cup 11 when the negative pressure is bigger than a preset value. For example, while the controller or the air pump malfunctions, the user can open the relief valve 17 to let the air flow into the cup 11 therethrough, for the safety of the user.

Figure 6:
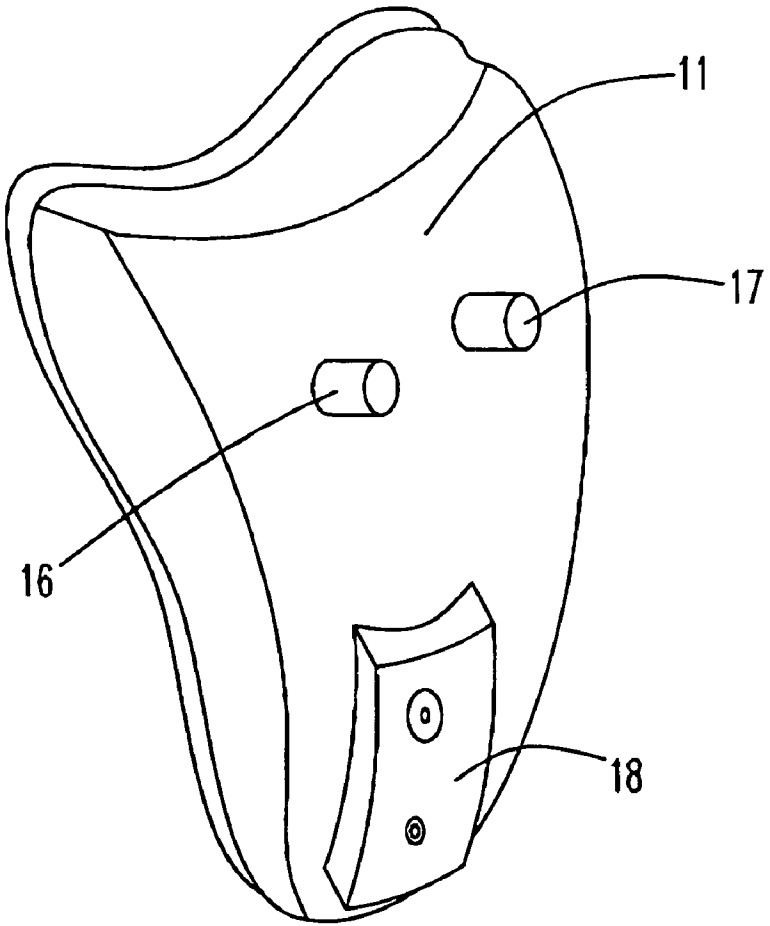
FIG. 6 is a schematic view showing the cup having a vibrator thereon according to the preferred embodiment of the present invention.
Figure 7:
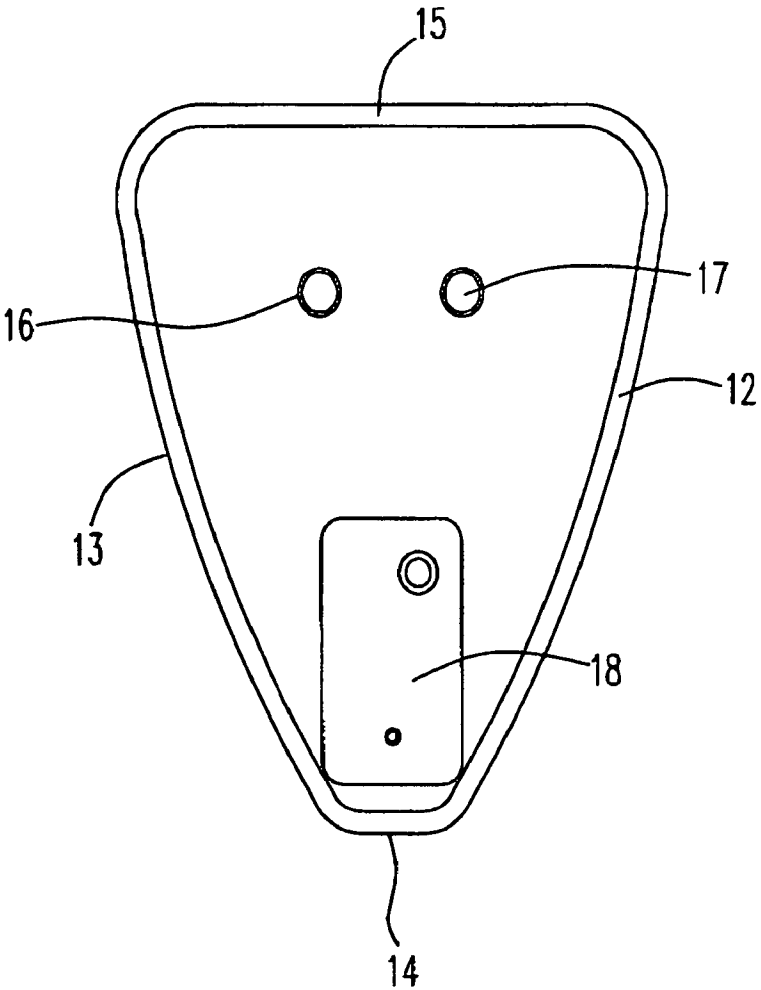
FIG. 7 is a front view according to the preferred embodiment of the present invention in FIG. 6.

Please refer to the FIGS. 6 and 7, showing the cup 11 has a vibrator 18 thereon according to the preferred embodiment of the present invention. The vibrator 18 creates a vibration such as a reciprocating motion. Or, the vibrator 18 is an eccentric device to generate an eccentric motion. Furthermore, the vibrator 18 is driven by an electric power (not shown in the drawings) from external or by a battery (not shown in the drawings) therein.

Figure 8:
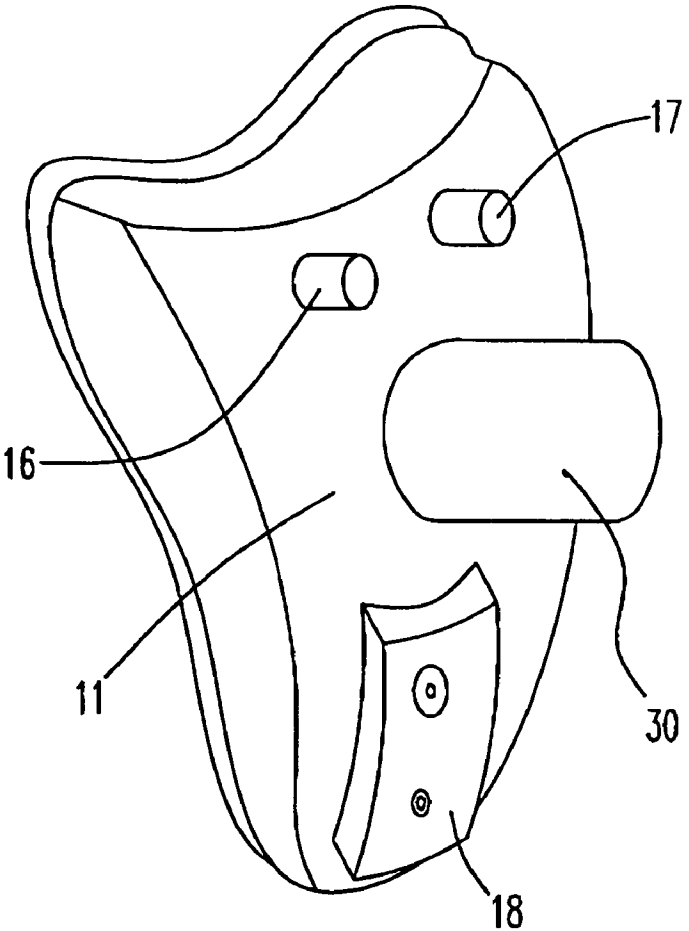
FIG. 8 is a schematic view showing the cup having a room thereon according to the preferred embodiment of the present invention.
Figure 9:
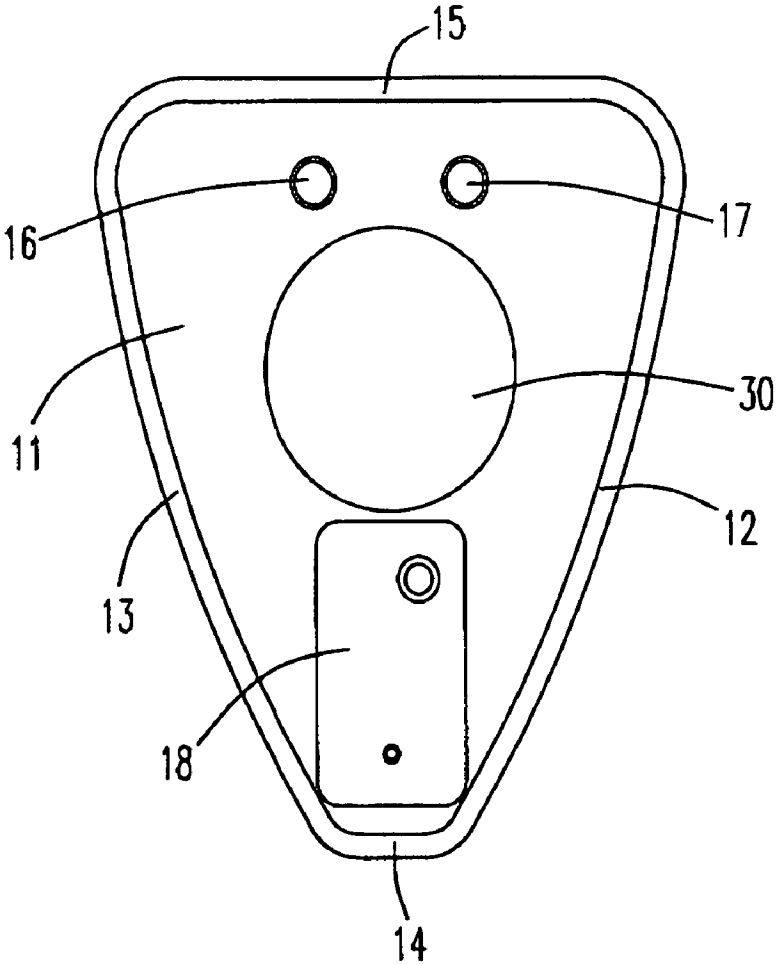
FIG. 9 is a front view according to the preferred embodiment of the present invention in FIG. 8.

Please refer to the FIGS. 8 and 9, showing the cup 11 further has a room 30 for a male user according to the preferred embodiment of the present invention. The room 30 is for a penis of the male user to be placed therein. Not only a female user can use the present invention, but a male user can use it for rectifying the incontinence of urine after a surgery of prostate, such as Benign Prostatic Hypertrophy (BPH) or the prostate cancer. The contraction of the pubococcygeus muscles can also be rectified by the present invention.

Figure 10:
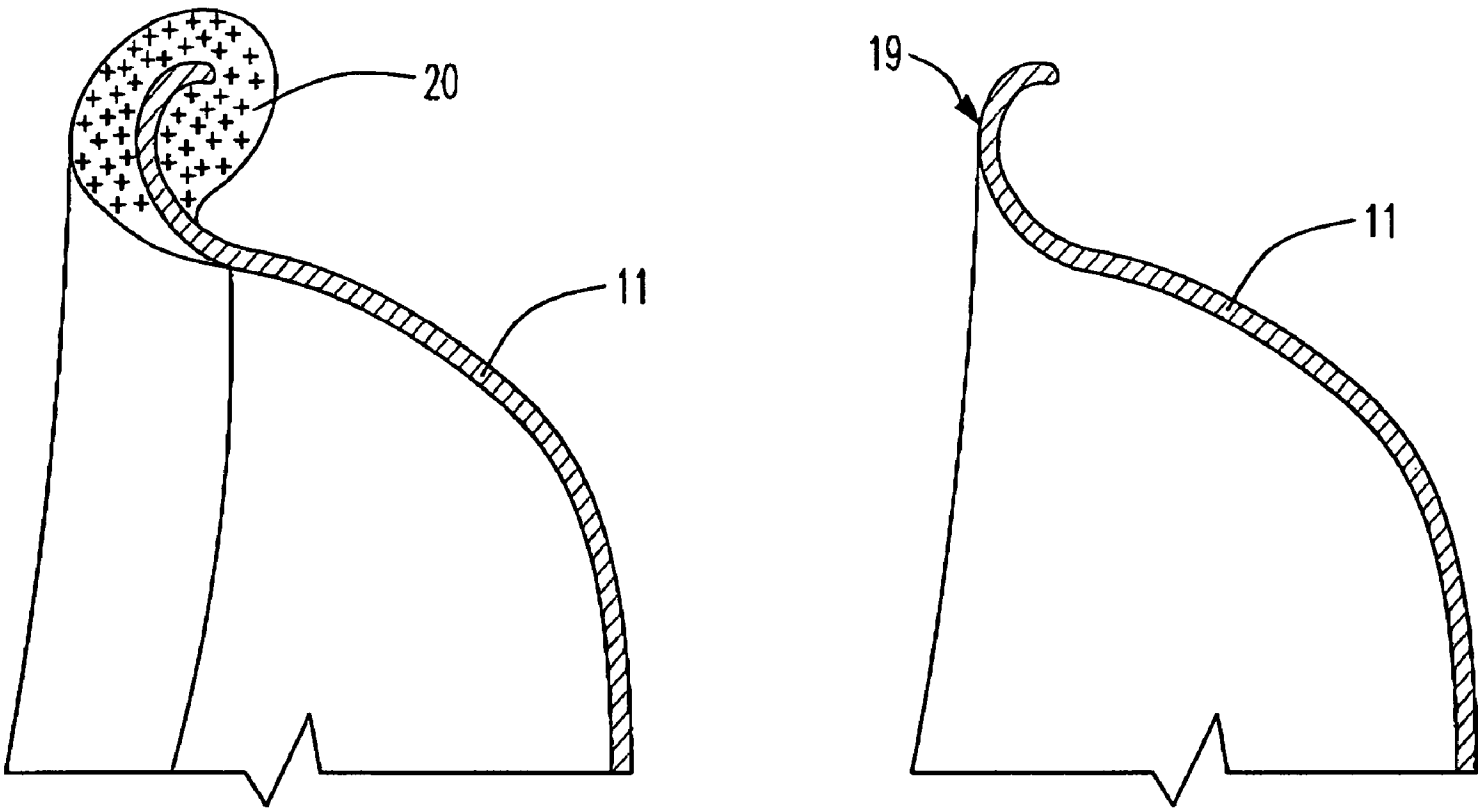
FIG. 10 is a sectional view showing a soft pad adhered on the opening of the cup according to a preferred embodiment of the present invention.

Please refer to FIG. 10. FIG. 10 sectionally illustrates the cup has a soft pad 20 adhered on the opening 19 of the cup 11 according to a preferred embodiment of the present invention. The soft pad 20 is able to make the user feel well and to distribute the adhering pressure of the cup 11. So, the congestion of the area adhered by the cup 11 can be rectified.

Figure 11:
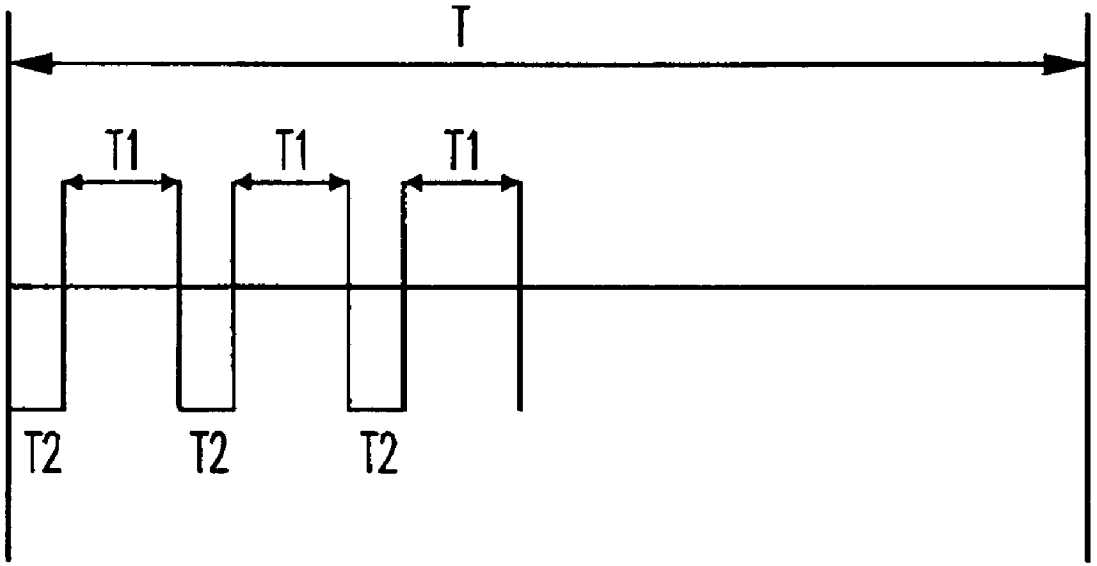
FIG. 11 is a schematic view showing one of the schedule of the present invention.
Figure 12:
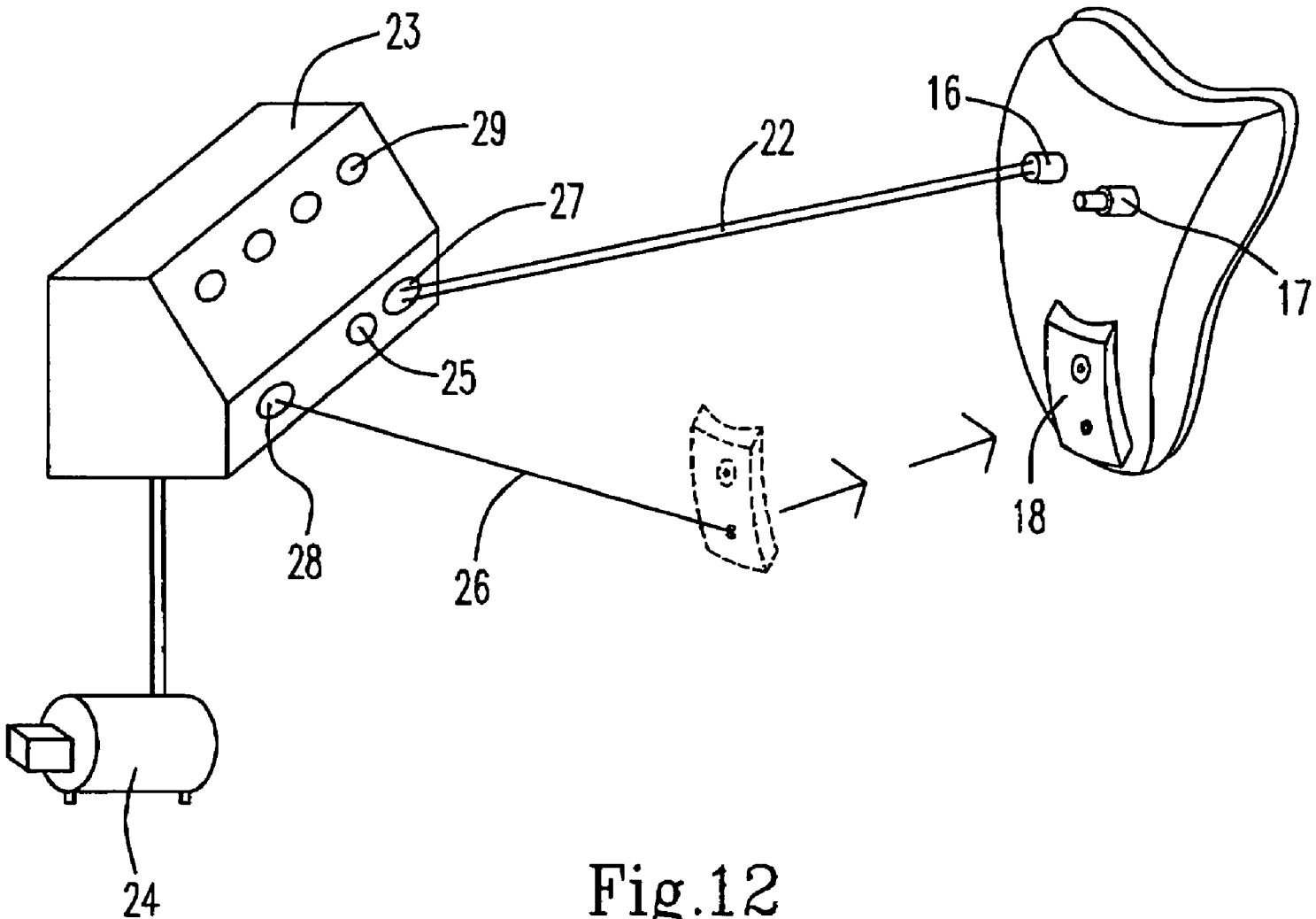
FIG. 12 is a schematic view showing the cup connected with a controller and an air pump according to the preferred embodiment of the present invention.

Please further refer to FIGS. 11 and 12. FIG. 11 shows one of the schedule of the present invention. And FIG. 12 shows the cup connected with a controller 23 and an air pump 24 according to the preferred embodiment of the present invention. The symbol T represents the total time period of the schedule. The symbol T1 represents the air pump 24 activating. The symbol T2 represents the release valve 25 activating. The controller 23 normally has an air pump 24 therein or is alternatively connected between the cup 11 and the air pump 24. The air pump 24 exhausts an air out from the cup 11 through a tube 22 and the controller 23. The tube 22 is connected to the cup 11 through the aperture 16 and to the controller 23 through a fixing aperture 27. A wire 26 is electrically connected to the vibrator 18 through the socket 28 and transfers an electric power and controlling signals from the controller 23. While the release valve 25 malfunctions, the relief valve 17 can take the responsibility for releasing the negative pressure inside the cup 11.

Figure 13:
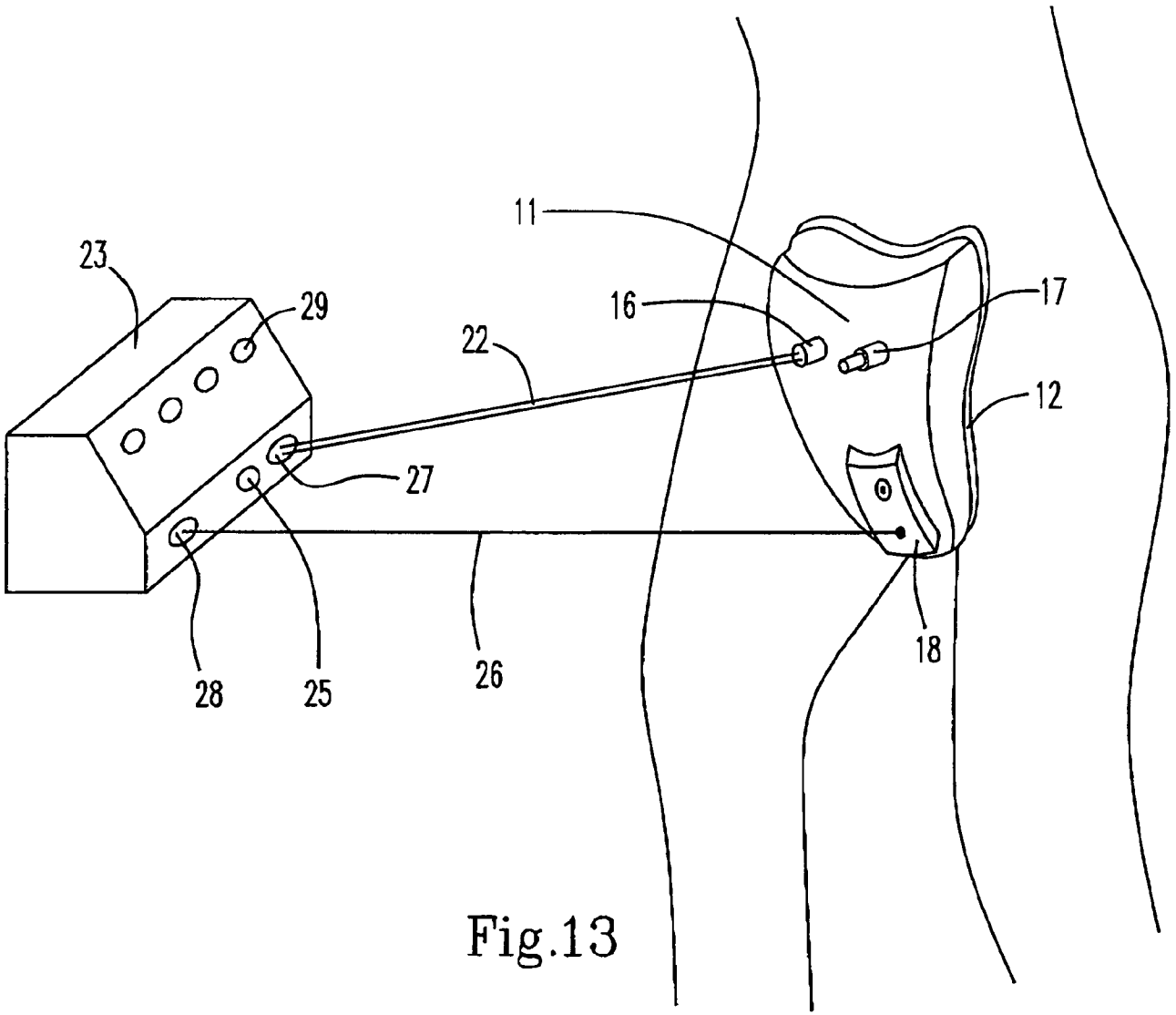
FIG. 13 is a schematic view showing the cup adhered on a hypogastrium of a user according to the preferred embodiment of the present invention.
Figure 14:
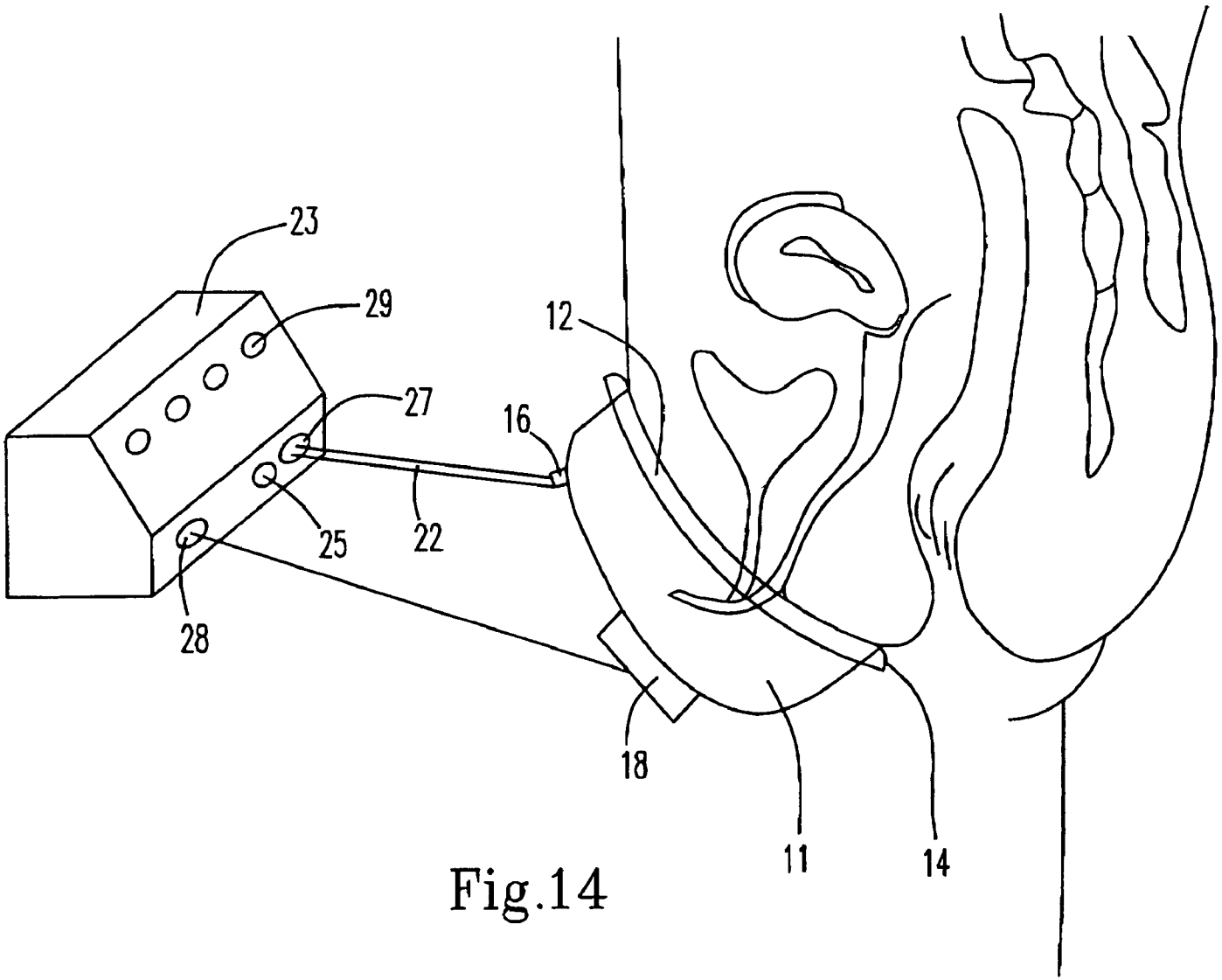
FIG. 14 is a sectional view showing a location of the cup relative to organs of a female user.

Please refer to FIGS. 13 and 14. FIG. 13 is a schematic view showing the cup adhered on a hypogastrium of a user according to the preferred embodiment of the present invention. And FIG. 14 is a sectional view showing a location of the cup relative to organs of a female user. In FIG. 13, it is very clear that the lateral side 12 is adhered on the join section of the leg and the body of the user. In FIG. 14, the cup 11 covers urethra, vagina, and perineum, and is very close to the anal. The lower side 14 is adhered on the anal area and very near to the anal of the user. It is very important that before using the cup 11, a user must have defecated and micturated first. When the controller 23 exhausts the air out from the cup 11, the hypogastrium is bulged, and the pubococcygeus muscles are extracted and then when the release valve 25 is released to let the air flow into the cup 11, the hypogastrium is restored and the pubococcygeus muscles are released. During several times of usage of the present invention, the pubococcygeus muscles of a user is trained very well and the endurances of the contraction and the explosive contraction are both raised.

The vibrator 18 is able to be activated during the action of the cup 11, for enhancing the circle of the blood around the hypogastrium of a user to rectify the congestion at the area adhered by the opening of the cup 11.

Although the present invention has been described and illustrated in detail, it is to be clearly understood that the same is by the way of illustration and example only and is not to be taken by way of limitation, the spirit and scope of the present invention being limited only by the terms of the appended claims.

What is claim is:

1. An apparatus for exercising a hypogastrium of a user, comprising:

a cup having:

a lateral side adapted to be adhered to a join section between a leg and a body of said user;

an upper side adapted to be adhered to an abdomen of said user; and a lower side adapted to be adhered an anal area of said user;

a tube connected to said cup;

a vibrator placed on said cup; and an air pump for sucking an air inside said cup out through said tube, wherein when said air is exhausted out from said cup, said hypogastrium is bulged, and then when said air gets into said cup, said hypogastrium is restored, such that, said hypogastrium is exercised by being released and contracted.

2. The apparatus as defined in claim 1, wherein said vibrator generates a vibration on said cup by driving an eccentric device.

3. The apparatus as defined in claim 1, wherein said vibrator generates a reciprocating motion.

4. The apparatus as defined in claim 1, wherein said vibrator is supplied by an external electric power.

5. The apparatus as defined in claim 1, wherein said vibrator has an electric power supplied by a battery placed therein.

6. The apparatus as defined in claim 1, further comprising a relief valve for releasing a negative pressure in said cup for safety while said negative pressure is bigger than a preset value.

7. The apparatus as defined in claim 1, wherein said cup further has a room for a male user.

8. The apparatus as defined in claim 1, further comprising a soft pad adhered along on said lateral side, said upper side, and said lower side.

9. The apparatus as defined in claim 1, wherein said air pump is a manual pump.

10. The apparatus as defined in claim 1, wherein said air pump comprises plural vacuum pumps.

11. The apparatus as defined in claim 1, wherein said air pump further comprises a controller for presetting an exercise schedule and controlling a strength, and a pumping speed.

12. The apparatus as defined in claim 11, wherein said exercise schedule comprises an air-exhausting scheme, an air-retrieving scheme and an vibration generated by said vibrator.

13. An apparatus for exercising a hypogastrium of a user, comprising:

a cup having an opening for covering said hypogastrium of said user;

a vibrator generating a vibration or a reciprocating motion, and placed on said cup for vibrating therewith; and an air pump for exhausting an air inside of said cup out, wherein said opening is adapted to be adhered to a join section of a leg and a body of said user, an abdomen of said user, and an anal of said user and the vibration is generated by driving an eccentric device.

14. The apparatus as defined in claim 13, wherein said cup further has a relief valve thereon for releasing a negative pressure in said cup for safety while said negative pressure is bigger than a preset value.

15. An apparatus for exercising a hypogastrium of a user, comprising:

a cup having an opening for covering said hypogastrium;

a vibrator placed on said cup for vibrating therewith;

an air pump for exhausting an air inside of said cup out through a tube; and a controller for controlling a pumping strength, a speed and a period provided by said air pump, wherein said opening is adapted to be adhered to a join section between a leg and a body of said user, an abdomen of said user, and an anal area of said user.

16. The apparatus as defined in claim 15, wherein said controller controls a frequency and an amplitude provided by said vibrator.

17. An apparatus for exercising a hypogastrium of a user, comprising:

a cup having:

a lower side;

an upper side wider than said lower side; and a lateral side disposed between said lower side and said upper side;

a tube connected to said cup;

a vibrator placed on said cup; and an air pump for sucking an air inside said cup out through said tube, wherein when said air is exhausted out from said cup, said hypogastrium is bulged, and then when said air gets into said cup, said hypogastrium is restored, such that, said hypogastrium is exercised by being released and contracted.

18. An apparatus for exercising a hypogastrium of a user, comprising:

a cup having an opening, an upper side and a lower side;

a vibrator placed on said cup for vibrating therewith; and an air pump for exhausting an air inside of said cup out, wherein said cup is gradually wider from said lower side to said upper side.

19. An apparatus for exercising a hypogastrium of a user, comprising:

a cup having an opening;

a vibrator placed on said cup for vibrating therewith;

an air pump for exhausting an air inside of said cup out through a tube; and a controller for controlling said air pump, wherein said opening is substantially trapezoid.

* * * * *